US010844527B2

(12) United States Patent
Nasarczyk et al.

(10) Patent No.: US 10,844,527 B2
(45) Date of Patent: Nov. 24, 2020

(54) KNITTED FABRIC

(71) Applicant: Gale Pacific Limited, Braeside (AU)

(72) Inventors: Andrew Nasarczyk, Braeside (AU); Garth Graham, Braeside (AU); Shane Graham, Braeside (AU); Ross Griffith, Braeside (AU); David Kost, Braeside (AU)

(73) Assignee: GALE PACIFIC LIMITED, Victoria Braeside (AU)

( * ) Notice: Subject to any disclaimer, the term of this patent is extended or adjusted under 35 U.S.C. 154(b) by 309 days.

(21) Appl. No.: 16/063,958

(22) PCT Filed: Nov. 29, 2016

(86) PCT No.: PCT/AU2016/051166
§ 371 (c)(1),
(2) Date: Jun. 19, 2018

(87) PCT Pub. No.: WO2017/106906
PCT Pub. Date: Jun. 29, 2017

(65) Prior Publication Data

US 2020/0270783 A1 Aug. 27, 2020

(30) Foreign Application Priority Data

Dec. 22, 2015 (AU) ..... 2015905329

(51) Int. Cl.
*D04B 21/16* (2006.01)

(52) U.S. Cl.
CPC ..... *D04B 21/16* (2013.01); *D10B 2503/02* (2013.01)

(58) Field of Classification Search
CPC ..... D04B 21/06; D04B 21/16; D04B 21/08; D04B 23/12
(Continued)

(56) References Cited

U.S. PATENT DOCUMENTS 3,474,644 A * 10/1969 Frank ..... D04B 21/00 66/203
4,067,210 A * 1/1978 Arons ..... D04B 21/14 139/420 R
(Continued)

FOREIGN PATENT DOCUMENTS

EP 0510682 A1 10/1992
WO 03014449 A1 2/2003

OTHER PUBLICATIONS

PCT International Search Report and Written Opinion; International Application No. PCT/AU2016/051166; International Filing Date: Nov. 29, 2016; dated Feb. 22, 2017; pp. 1-14.
(Continued)

*Primary Examiner* — Danny Worrell
(74) *Attorney, Agent, or Firm* — Cantor Colburn LLP

(57) ABSTRACT

A knitted fabric (10) including a plurality of parallel chains of knitted loops (12), with each chain of knitted loops (12) formed from a respective yarn, and with the parallel chains of knitted loops (12) extending in the warp or vertical direction. The fabric (10) also includes a plurality of weft yarns (14), with each weft yarn (14) connected to and extending across at least two adjacent chains of knitted loops (12). Each chain of knitted loops (12) is also associated with at least one respective yarn 16, (18) that is connected to, and intertwines along the chain of knitted loops (12).

13 Claims, 2 Drawing Sheets

(58) Field of Classification Search
USPC ..... 66/192, 193, 195
See application file for complete search history.

(56) References Cited

U.S. PATENT DOCUMENTS

| | | | | | |
|---|---|---|---|---|---|
| 4,626,465 | A * | 12/1986 | Henningsson | D03D 1/007 | 442/186 |
| 4,632,863 | A * | 12/1986 | Henningsson | A01G 9/1438 | 442/186 |
| 5,288,545 | A * | 2/1994 | De Decker | D03D 15/00 | 422/185 |
| 5,542,269 | A * | 8/1996 | Richards | D04B 21/18 | 66/192 |
| 6,615,618 | B2 * | 9/2003 | Kost | D04B 21/10 | 66/193 |
| 6,688,143 | B2 * | 2/2004 | Williams | D04B 21/16 | 442/310 |
| 6,840,066 | B2 * | 1/2005 | Dickerson | D04B 21/18 | 66/192 |
| 8,056,373 | B2 * | 11/2011 | Kazuma | D04B 21/10 | 66/195 |
| 9,809,910 | B2 * | 11/2017 | De Keyzer | D04B 21/14 | |
| 2002/0184925 | A1 * | 12/2002 | McClellan | D04B 21/18 | 66/195 |
| 2003/0061839 | A1 | 4/2003 | Kost | | |
| 2004/0035154 | A1 | 2/2004 | Bailey | | |

OTHER PUBLICATIONS

PCT Notification of Transmittal of International Preliminary Report on Patentability; International Application No. PCT/AU2016/051166; International Filing Date: Nov. 29, 2016; dated Sep. 12, 2017; pp. 1-16.

* cited by examiner

KNITTED FABRIC

CROSS REFERENCE TO RELATED APPLICATIONS

This application is a National Stage application of PCT/AU2016/051166, filed Nov. 29, 2016, which claims the benefit of Australian Application No. 2015905329, filed Dec. 22, 2015, the contents of which are incorporated by reference in their entirety herein.

TECHNICAL FIELD

The present invention relates to a knitted fabric. The fabric has been specifically designed for use as solar shade and/or hail and/or wind protection cloth and will herein be generally described in this context. The fabric may be utilised in temporary, semi-permanent or permanent structure applications.

It is to be appreciated, however, that the fabric may be utilised in other applications besides those referred to above.

BACKGROUND OF INVENTION

Existing knitted fabrics, particularly those designed for use as shade cloth, are most commonly manufactured on warp knitting machines, utilising structures based on net knitting technology.

Such fabrics are typically manufactured from monofilament of high-density polyethylene (HDPE), split film high-density polyethylene yarns (or fibres) or polypropylene.

Nets typically comprise chains of knitted loops in the warp direction that are interconnected by yarns or fibres laid-in around the knitted loops and lying in the weft direction. In the manufacture of shade cloth, it is common to introduce yarns in the weft direction by knitting them into the loop structure and having relatively large movements across several needles in the underlap phase of the knitting cycle. In knitting terminology generic shade cloth structures can be described as open loop pillar stitch on a front guide bar accompanied by knitted or laid-in yarns with underlaps of several (say 3 to 5) needle spaces.

The multiple number of yarns in the weft direction, compared to the single vertical underlap of the pillar stitch lead to considerable imbalance in the strength and load carrying capacity of the fabric in the warp and weft directions, which is undesirable, particularly in the context of shade cloth. Often, the warp direction strength will be as low as 25% of the strength in the weft direction, and this can result in failure of the fabric when in tension in the warp direction.

It would therefore be desirable to provide a fabric suitable for any or all of a solar shade, hail and wind protection cloth that addresses the above shortcomings, and which has enhanced mechanical properties when compared to existing shade cloth fabrics. Particularly, but not exclusively, it would be desirable to provide a fabric suitable for use as a shade cloth that has an improved load bearing capacity in the warp direction, and improved balance when comparing strengths in the warp and weft directions, whilst providing high levels of opacity (and, thus, protection from UV radiation) expected of shade cloth fabrics. Likewise, it would be desirable to provide hail and/or wind protection cloth that addresses the above shortcomings.

SUMMARY OF INVENTION

According to a broad aspect of the present invention, there is provided a knitted fabric. The fabric includes a plurality of parallel chains of knitted loops, with each chain of knitted loops formed from a respective yarn, and with the parallel chains of knitted loops extending in the warp or vertical direction. The fabric also includes a plurality of weft yarns, with each weft yarn connected to and extending across at least two adjacent chains of knitted loops. Each chain of knitted loops is also associated with at least one respective yarn that is connected to, and intertwines along the chain of knitted loops.

In one embodiment, each chain of knitted loops is knitted with yarns that traverse across several needle spaces before being knitted on an adjacent needle to form long underlaps or weft yarns. Each chain of knitted loops is also associated with a pair of intertwining yarns, with each yarn of the pair being connected to and extending along the chain of knitted loops. In one form, each pair of intertwining yarns includes a first yarn connected to the respective chain of knitted loops, and a second yarn connected to the chain of knitted loops in a mirror image arrangement to that of the first yarn about the approximate centre line of the respective chain of knitted loops. The intertwining yarns can be considered as load bearing yarns in the warp direction. That is, they enhance the load bearing capacity of the fabric in the warp direction, which is a highly desirable feature of the invention.

Each of the chains of knitted loops, weft yarns and intertwining yarns may be manufactured from at least one of a monofilament, multi-filament and split film. In one form, each of the chains of knitted loops, weft yarns and intertwining yarns is manufactured from a monofilament.

Each of the chains of knitted loops, weft yarns and intertwining yarns may be manufactured from at least one synthetic of nylon, poly-propylene, polyester, ultra-high molecular weight high-density polyethylene (UHMWHDPE) and high-density polyethylene (HDPE), or other engineered fibres. In one form, each of the chains of knitted loops, weft yarns and intertwining yarns is manufactured at least substantially from high-density polyethylene (HDPE).

It is envisaged that the fabric may be manufactured on a compound or latch needle warp knitting machine, with four guide bars of the knitting machine being utilised to manufacture the fabric. In such an arrangement, the four guide bars may include a front (or first) guide bar, a second guide bar, a third guide bar and a fourth guide bar that may follow the following knitting movements to manufacture the fabric:

front guide bar: 0-1/1-0;
second guide bar: 1-0/4-5;
third guide bar: 0-0/1-1/1-1/0-0; and
fourth guide bar: 1-1/0-0/0-0/1-1

However, it is to be appreciated that other knitting patterns are possible. In one alternative form, each intertwining yarn is provided at an angle to the warp or vertical direction.

In use, the front guide bar supplies the yarn for the chain of knitted loops, the second guide bar supplies the weft yarn, and the third and fourth guide bars supply the first and second intertwining yarns, respectively.

It is envisaged that the fabric according to the present invention would be particularly suitable for use as any one or more of a solar shade, hail and wind cloth protection fabric.

The thickness of each of the warp yarns, weft yarns and intertwining yarns may be selected as desired. The applicant envisages a thickness somewhere between approximately 300 and 1,000 denier, with a thickness of approximately 300 to 500 denier currently being envisaged by the applicant as being suitable for use in at least one embodiment of the invention.

In one or more embodiments of the invention, at least some of the intertwining yarns may be knitted or tied to their respective chains of knitted loops. Knitting or tying of the intertwining yarns to the chains of knitted loops may be provided intermittently along the chain of knitted loops.

In some embodiments, it may be desirable to include additional warp yarns in the fabric, with the additional warp yarns provided in an interwoven configuration within the fabric by one or more of a selective miss-lap technique and evasive laying-in technique.

BRIEF DESCRIPTION OF DRAWINGS

It will be convenient to hereinafter describe preferred embodiments of the invention with reference to the accompanying drawings. The particularity of the drawings is to be understood as not limiting the preceding broad description of the invention.

DETAILED DESCRIPTION

Figure 1:
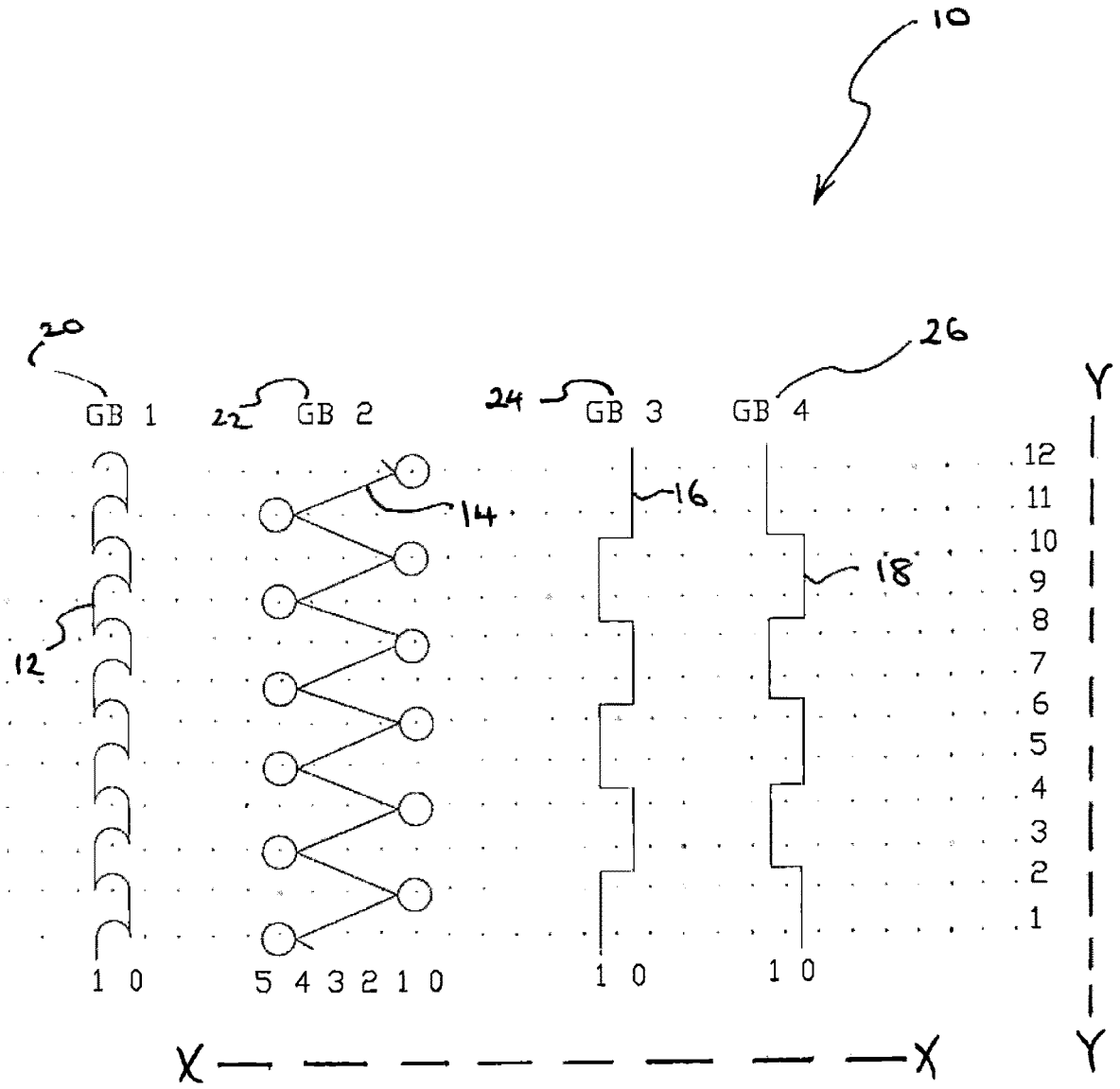
FIG. 1 is a schematic view of a knitted fabric according to one embodiment of the present invention. The matrix of dots represent knitted loops, vertical rows in the warp or machine direction, and horizontal rows in the weft or lateral direction. The fabric components have been separated out and are shown in a side-by-side arrangement for clarity. In practice, loops would be formed in each column and row.

Referring to FIG. 1, there is depicted a knitted fabric 10 suitable for use as shade cloth (and/or wind protection and/or hail protection cloth). As stated previously, the fabric components have been separated out and are shown in a side-by-side arrangement for clarity.

The fabric 10 includes a plurality of parallel chains 12 of knitted loops, with only one chain 12 being shown. The chains 12 are arranged parallel to one another and extend in the warp direction Y-Y. In the illustrated embodiment, each chain 12 is manufactured from a respective monofilament yarn of high-density polyethylene, although other suitable yarns may be used instead.

The fabric 10 also includes a plurality of weft yarns 14, although only one such weft yarn is shown. Each of the weft yarns 14 is manufactured from a respective monofilament yarn of high-density polyethylene, although other suitable yarns may be used instead. Each weft yarn 14 extends in the weft direction X-X, and extends about or through at least two adjacent chains 12 of knitted loops. Indeed, the fabric may be designed such that each weft yarn 14 extends about or through any practical number of adjacent chains 12.

Each chain 12 of knitted loops is associated with a pair of yarns 16, 18. Each yarn 16, 18 is connected to and intertwines along the chain 12 of knitted loops. It is to be appreciated that the yarn 18 is intertwined with the chain 12 in a mirror image arrangement when compared to yarn 16 about the approximate longitudinal centre line of the chain 12. That is, yarn 18 is underlapped in the opposite direction to yarn 16. It can be seen that the yarns 16, 18 provide an enclosure around two successive knitted loops, providing restriction to the stretching of the loops of the chain 12 when under tension, as well as contributing load bearing capacity to the fabric 10 in the warp direction Y-Y. The provision of yarns about pillar stitch columns (such as those of chains 12) is an element that the applicant is aware of having been used in net constructions, including laces. However, in those constructions, connection of the yarns to the pillar stitch occurs at each course, with the intention of "hiding" the yarn until moved several needle spaces during the underlap phase of a knitting cycle to produce horizontal yarn elements to yield the net structure. Relatively little mechanical benefit is obtained from these yarns in the vertical (or warp) direction. The applicant is also aware of previous attempts at running reinforcing yarns down chain stitches so as to act as a tear resistant component. In such arrangements, the reinforcing yarns lap around the needle loop at each course, and, unlike the present invention, little if any dimensional stability increase is obtained.

Like each chain 12 and weft yarn 14, each intertwining yarn 16, 18 of the illustrated embodiment is manufactured from a respective monofilament yarn of high-density polyethylene, although other suitable yarns may be used instead.

The fabric 10 is manufactured on a latch needle warp knitting machine, with four guide bars of the knitting machine being utilised to manufacture the fabric, and each introducing a yarn into the fabric structure. In such an arrangement, the four guide bars may include a front (or first) guide bar 20, a second guide bar 22, a third guide bar 24 and a fourth guide bar 26 that follow the following knitting movements to manufacture the fabric 10:

front guide bar: 0-1/1-0;
second guide bar: 1-0/4-5;
third guide bar: 0-0/1-1/1-1/0-0; and
fourth guide bar: 1-1/0-0/0-0/1-1

In use, the front guide bar 20 supplies the yarn for the chain 12 of knitted loops, the second guide bar supplies the weft yarn 14, and the third and fourth guide bars supply the first and second intertwined yarns 16, 18, respectively.

The front guide bar 20 carries yarn of chains 12 around the needle hooks (overlap) to produce vertical rows of loops in a configuration known as open loop pillar stitch. On the successive course, the traverse around the needle hooks is in the opposite direction. There is no underlap movement. The second guide bar 22 carries the weft yarn 14 around the needle hooks (overlap) and then across the back of the needles for several needle spaces during the underlap part of the knitting cycle. It is to be appreciated that the size of these underlaps may be varied to manipulate the weight of the fabric 10 and its horizontal stability. The second guide bar 22 enters and exits between the needles during the overlap part of the knitting cycle, thus being joined to the knitted loops as "laid-in" yarns. The third guide bar 24 carries yarn 16 making no underlap movement for one or more knitting cycles as well as no overlaps, and then moves one needle space of underlap before repeating the miss-lap cycle and returning to its original position. It is to be appreciated that the fourth guide bar 26 performs the same role with yarn 18 as the third guide bar 24 does with yarn 16, but makes underlap movements in the opposite direction to the third guide bar 24. The yarns 16, 18 introduced by the third and fourth guide bars 24, 26, respectively, provide an enclosure around two successive knitted loops, providing restriction to the stretching of the loops under tension as well as contributing fabric load bearing capacity in their own right. Careful balancing of the run-ins of the guide bars, 20, 22, 24, 26 optimizes the load bearing capacity of the fabric 10 in both vertical (warp) and horizontal (weft) directions.

Thus, it can be appreciated that the front and second guide bars 20, 22 provide the two-dimensional structure of the fabric 10; whereas the third and fourth guide bars 24, 26 supply yarns 16, 18, respectively, enclose the knitted loops, restricting their ability to deform under load, and providing additional load carrying capacity and stretch resistance. It is envisaged that the yarns 16, 18 may, instead, be replaced by yarns from a single guide bar.

The interaction of at least three (and preferably four) yarn components is integral to the success of this invention. The four yarns have separate and specific roles namely: chains of loops 12 formed vertically which hold the horizontally oriented components to form the basic two dimensional structure, with additional yarns 16, 18 constraining each knitted chain 12 from distortion under load and adding vertical strength. The interactions generated by the enclosing of the knitted cells over more than one course by two opposed yarns 16, 18 running up the chains 12 gives controllable load sharing and movement limitation in the knitted loops, and tightens the grip of the loops on the horizontal laid-in yarns. Balance between these components is achieved by control of run-in to optimize outcomes.

The denier of the yarns of the chain 12, weft yarns 14 and intertwining yarns 16, 18 may be selected as desired. As stated previously, the applicant envisages a thickness somewhere between approximately 300 and 1,000 denier, with a thickness of approximately 300 to 500 denier currently being envisaged by the applicant as being suitable for use in at least the illustrated FIG. 1 embodiment of the invention.

The applicant has established during trials of the fabric 10 that the fabric strength in the warp direction is actually slightly stronger than that in the weft direction. This is considered by the applicant to be unique to their invention, at least in the context of solar shade cloth (as well as hail and/or wind protection cloth), and is as a result of improved overall strength in the warp direction rather than any decrease in weft direction strength. This improved warp direction strength and more balanced strength in the warp and weft directions is highly desirable in the context of shade cloth. Moreover, it clearly distinguishes the applicant's fabric 10 from their competitor's products that lack warp direction strength and aren't strength balanced in the warp and weft directions. The applicant's fabric 10 is not only strong and balanced, it also desirably provides high levels of opacity (and, thus, protection from UV radiation) expected of shade cloth fabrics.

Figure 2:
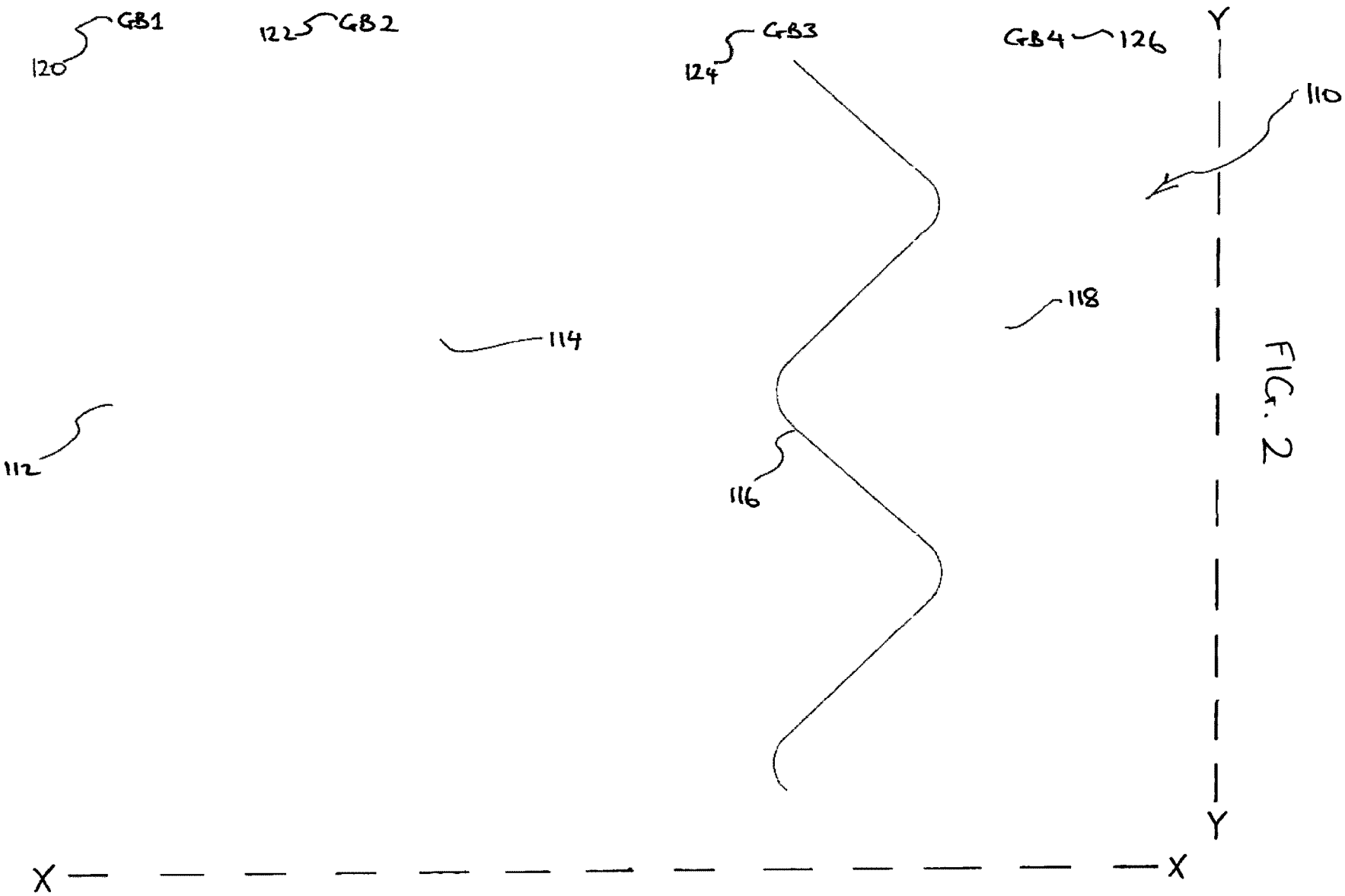
FIG. 2 is a schematic view of a knitted fabric according to another embodiment of the present invention. Some of the fabric components have been separated out and are shown in a side-by-side arrangement for clarity.

Referring to FIG. 2, there is depicted a knitted fabric 110 suitable for use as shade cloth (and/or wind protection and/or hail protection cloth). Some of the fabric components have been separated out and are shown in a side-by-side arrangement for clarity.

The fabric 110 includes a plurality of parallel chains 112 of knitted loops, with only one chain 112 being shown. The chains 112 are arranged parallel to one another and extend in the warp direction Y-Y. In the illustrated embodiment, each chain 112 is manufactured from a respective monofilament yarn of high-density polyethylene, although other suitable yarns may be used instead.

The fabric 110 also includes a plurality of weft yarns 114, although only one such weft yarn is shown. Each of the weft yarns 114 is manufactured from a respective monofilament yarn of high-density polyethylene, although other suitable yarns may be used instead. Each weft yarn 114 extends in the weft direction X-X, and extends about or through at least two adjacent chains 112 of knitted loops. Indeed, the fabric 110 may be designed such that each weft yarn 114 extends about or through any practical number of adjacent chains.

Each chain 112 of knitted loops is associated with a pair of biaxial yarns 116, 118 provided at an angle to the warp direction Y-Y. Yarns 116, 118 are shown in an overlaid arrangement. Each yarn 116, 118 is connected to and intertwines along the chain 112 of knitted loops. It can be seen that the yarn 118 is provided in a mirror image arrangement when compared to yarn 116. Each yarn 116, 118 may be provided such it intertwines any practical number of chains. The yarns 116, 118 can be considered as load bearing yarns in the warp direction. That is, they enhance the load bearing capacity of the fabric in the warp direction, which is a highly desirable feature of the invention.

Like each chain 112 and weft yarn 114, each intertwining yarn 116, 118 of the illustrated embodiment is manufactured from a respective monofilament yarn of high-density polyethylene, although other suitable yarns may be used instead.

The fabric 110 is manufactured on a latch needle warp knitting machine, with four guide bars of the knitting machine being utilised to manufacture the fabric, and each introducing a yarn into the fabric structure.

It is to be appreciated that front and second guide bars 120, 122 provide the two-dimensional structure of the fabric 110; whereas third and fourth guide bars 124, 126 supply yarns 116, 118, respectively, enclose the knitted loops, restricting their ability to deform under load, and providing additional load carrying capacity and stretch resistance. It is envisaged that the yarns 116, 118 may, instead, be replaced by yarns from a single guide bar.

The denier of the yarns of the chain 112, weft yarns 114 and intertwining yarns 116, 118 may be selected as desired. As stated previously, the applicant envisages a thickness somewhere between approximately 300 and 1,000 denier, with a thickness of approximately 300 to 500 denier currently being envisaged by the applicant as being suitable.

A reference herein to a patent document or other matter which is given as prior art is not to be taken as an admission that the document or matter was known or that the information it contains was part of the common general knowledge as at the priority date of any of the claims.

It is to be understood that various alterations, modifications and/or additions may be introduced into the construction and arrangement of the parts previously described without departing from the spirit or ambit of this invention.

The invention claimed is:

1. A knitted fabric, comprising:

a plurality of parallel chains of knitted loops, with each chain of knitted loops formed from a respective yarn, and with the chains of knitted loops extending in the warp or vertical direction; and a plurality of weft yarns, with each weft yarn connected to and extending across at least two adjacent chains of knitted loops;

wherein each chain of knitted loops is associated with a pair of intertwining yarns, with each yarn of the pair of intertwining yarns being connected to, intertwined with and extending along the chain of knitted loops;

the fabric is manufactured on a compound or latch needle warp knitting machine, and four guide bars of the compound or latch needle warp knitting machine are utilised to manufacture the fabric, the four guide bars comprising a front guide bar, a second guide bar, a third guide bar and a fourth guide bar that follow the following knitting movements to manufacture the fabric:

front guide bar: 0-1/1-0;

second guide bar: 1-0/4-5;

third guide bar: 0-0/1-1/1-1/0-0; and fourth guide bar: 1-1/0-0/0-0/1-1, with the front guide bar, in use, supplying the yarn for the chain of knitted loops, the second guide bar supplying the weft yarn, and the third and fourth guide bars supplying the first and second intertwined yarns, respectively.

2. The knitted fabric according to claim 1, wherein each pair of intertwining yarns comprises a first yarn intertwined with the respective chain of knitted loops, and a second yarn intertwined with the respective chain of knitted loops.

3. The knitted fabric according to claim 1, wherein each of the chains of knitted loops, weft yarns and intertwining yarns is manufactured from at least one of a monofilament, multi-filament and split film.

4. The knitted fabric according to claim 3, wherein each of the chains of knitted loops, weft yarns and intertwining yarns is manufactured from a monofilament.

5. The knitted fabric according to claim 1, wherein each of the chains of knitted loops, weft yarns and intertwining yarns is manufactured from at least one synthetic of nylon, polypropylene, polyester, ultra-high molecular weight high density polyethylene (UHMWHDPE) and high-density polyethylene (HDPE).

6. The knitted fabric according to claim 5, wherein each of the chains of knitted loops, weft yarns and intertwining yarns is manufactured at least substantially from high-density polyethylene (HDPE).

7. The knitted fabric according to claim 1, wherein the fabric is one or more of a solar shade, hail and wind cloth protection fabric.

8. The knitted fabric according to claim 1, wherein the mass density of each of the yarns, weft yarns and intertwining yarns is between 300 and 1,000 denier.

9. The knitted fabric according to claim 8, wherein the mass density of each of the yarns, weft yarns and intertwining yarns is 300 to 500 denier.

10. The knitted fabric according to claim 1, wherein at least some of the intertwining yarns are knitted or tied to their respective chains of knitted loops.

11. The knitted fabric according to claim 10, wherein at least some of the intertwining yarns are knitted to their respective chains of knitted loops intermittently along the chain of knitted loops.

12. The knitted fabric according to claim 1, comprising additional warp yarn provided in an interwoven configuration with the fabric by one or more of a selective miss-lap technique and evasive laying-in technique.

13. The knitted fabric according to claim 1, wherein each intertwining yarn is provided at an angle to the warp or vertical direction.

* * * * *